US008280266B2

(12) United States Patent
Ozeki

(10) Patent No.: US 8,280,266 B2
(45) Date of Patent: Oct. 2, 2012

(54) IMAGE FORMING APPARATUS

(75) Inventor: Fumitaka Ozeki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 471 days.

(21) Appl. No.: 12/551,135

(22) Filed: Aug. 31, 2009

(65) Prior Publication Data

US 2010/0067930 A1 Mar. 18, 2010

(30) Foreign Application Priority Data

Sep. 17, 2008 (JP) ..... 2008-238559

(51) Int. Cl.
*G03G 15/06* (2006.01)

(52) U.S. Cl. ..... 399/43; 399/70

(58) Field of Classification Search ..... 399/43, 399/50, 70, 89, 128
See application file for complete search history.

(56) References Cited

U.S. PATENT DOCUMENTS

| | | | | |
|---|---|---|---|---|
| 7,831,162 | B2 * | 11/2010 | Yamane | 399/50 |
| 2008/0298826 | A1 * | 12/2008 | Yonekubo | 399/44 |

FOREIGN PATENT DOCUMENTS

| | | | |
|---|---|---|---|
| JP | 09-187985 | A | 7/1997 |
| JP | 2002-169343 | A | 6/2002 |
| JP | 2002-169445 | A | 6/2002 |
| JP | 2008-89622 | A | 4/2008 |

* cited by examiner

*Primary Examiner* — Walter L Lindsay, Jr.

*Assistant Examiner* — Barnabas Fekete

(74) *Attorney, Agent, or Firm* — Marvin A. Motsenbocker; MOTS Law, PLLC

(57) ABSTRACT

An image forming apparatus includes an image forming unit having image forming elements and a fixing unit. The image forming elements includes an image carrier, a charging unit, a developer carrier, and a developer supplier. The image forming apparatus further includes a post unoperated period image formation preparation processor operable to, when the unoperated period, which is a time period from an end of an image forming operation to a start of a subsequent image forming operation is equal to or greater than a threshold, perform an idling operation to rotate the image carrier while applying a post unoperated period image formation preparation voltage, which is different from a normal image formation voltage, to a given one or more of the image forming elements.

22 Claims, 9 Drawing Sheets

IMAGE FORMING APPARATUS

CROSS REFERENCE TO RELATED APPLICATIONS

This application claims priority based on 35 USC 119 from prior Japanese Patent Application No. P2008-238559 filed on Sep. 17, 2008, entitled "Image Forming Apparatus", the entire contents of which are incorporated herein by reference.

BACKGROUND OF THE INVENTION

1. Field of the Invention

The present invention relates to an image forming apparatus.

2. Description of Related Art

Regarding a conventional image forming apparatus such as a printer, a copying machine, a facsimile machine and a multifunctional machine, in a printer as an example, an exposure unit exposes light on a photosensitive drum on which a charging unit uniformly charges electricity to form an electrostatic latent image, a developing unit develops the electrostatic latent image to form a toner image on the photosensitive drum, and then the toner image is transferred onto a paper sheet and fixed thereon.

The developing unit has a developing roller configured to adhere toner on an electrostatic latent image on the photosensitive drum, a toner supply roller configured to supply toner to the developing roller and a development blade configured to form a thin toner layer on the developing roller. The toner supplied from the toner cartridge to the developing unit is charged by development voltage applied to the developing roller and supply voltage applied to the toner supply roller and charged by a triboelectrification between the developing roller and toner supply roller and between the developing roller and development blade. This technology is disclosed, for example, in Japanese Patent Application Laid-Open No. 2002-169343.

However, in such a conventional printer, as an unoperated period which is the time period from an end of a print job to a beginning of a subsequent print job, become longer the image quality may deteriorate due to fogging, which is a phenomenon in which toner adheres in non-image areas on a paper sheet.

SUMMARY OF THE INVENTION

An aspect of the invention provides an image forming apparatus including an image forming unit having image forming elements and a fixing unit configured to fix the transferred developer image which has been transferred from the image carrier to the medium. The image forming elements includes an image carrier on which surface a latent image can be formed, a charging unit configured to receive charging voltage and charge the surface of the image carrier, a developer carrier configured to receive development voltage and form a developer image by adhering developer to the latent image formed on the image carrier, and a developer supplier configured to receive supply voltage and supplying the developer to the developer carrier. The image forming apparatus further includes: a voltage setting unit operable, when the unoperated period, which is a time period from an end of printing to a start of subsequent printing, is equal to or greater than a threshold, to set a post unoperated period image formation preparation voltage which is different from a normal image formation voltage, according to the unoperated period; and a post unoperated period image formation preparation processor operable to perform an idling operation to rotate the image carrier for a predetermined idling time while applying the post unoperated period image formation preparation voltage to a given one or more of the image forming elements.

According to the aspect of the invention, when the unoperated period is equal to or greater than the threshold, the image carrier is operated in the idling operation for the predetermined idling time while the post unoperated period image formation preparation voltage, which is different from the standard image formation voltage, is applied to the given one or more of the image forming elements. Therefore, the charge level of the developer and the surface potential of the image carrier can be maintained in preferable ranges. This prevents fogging caused by long unoperated periods and improves the image quality.

DETAILED DESCRIPTION OF EMBODIMENTS

Figure 1:
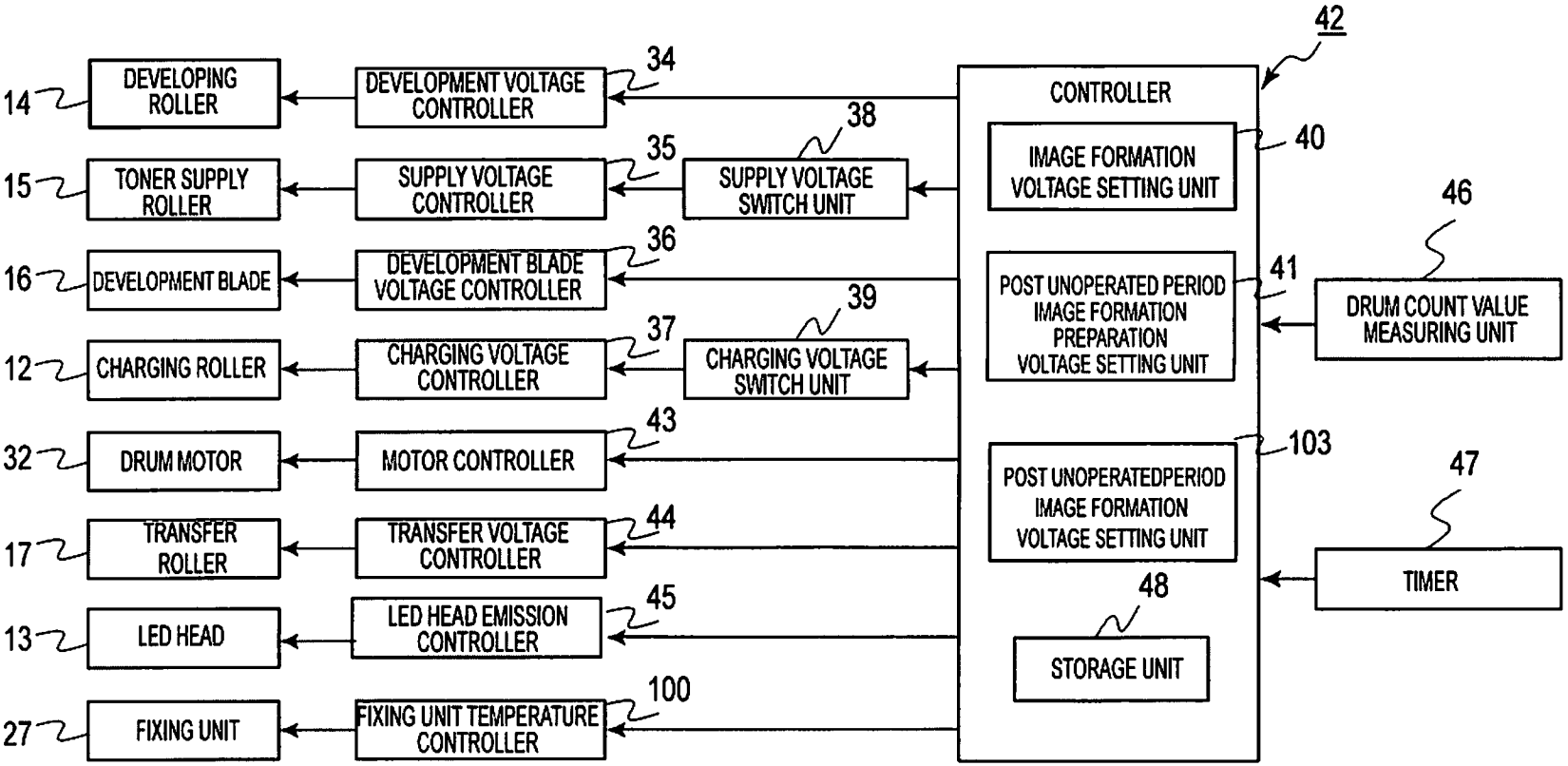
FIG. 1 is a control block diagram of a printer according to a first embodiment.

Descriptions are provided hereinbelow for embodiments based on the drawings. In the respective drawings referenced herein, the same constituents are designated by the same reference numerals and duplicate explanation concerning the same constituents is basically omitted. All of the drawings are provided to illustrate the respective examples only. No dimensional proportions in the drawings shall impose a restriction on the embodiments. For this reason, specific dimensions and the like should be interpreted with the following descriptions taken into consideration. In addition, the drawings include parts whose dimensional relationship and ratios are different from one drawing to another.

Embodiments of the invention will be described in detail with reference to the drawings. In the embodiments, a printer serving as an image forming apparatus will be described.

Figure 2:
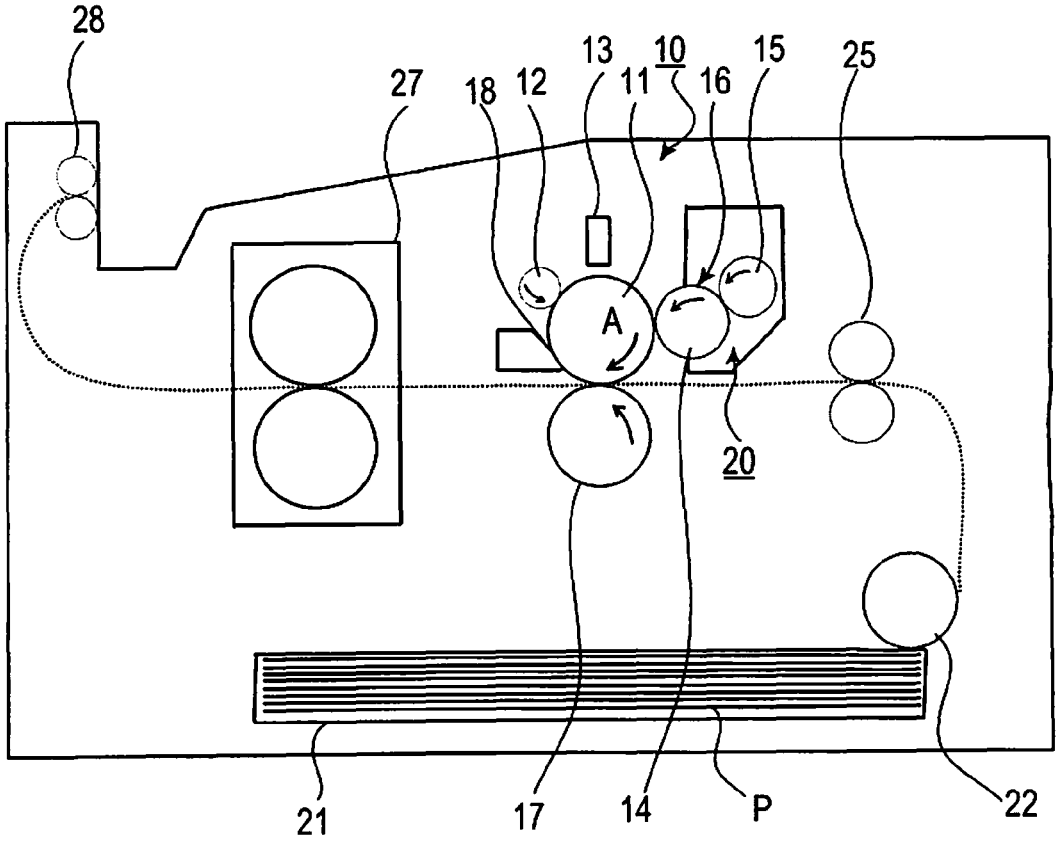
FIG. 2 is a conceptual diagram of the printer according to the first embodiment.

FIG. 2 is a conceptual diagram of a printer according to a first embodiment.

As shown in FIG. 2, image forming unit 10 includes photosensitive drum 11 serving as an image carrier, charging roller 12 serving as a charged member or a charging unit provided to contact with photosensitive drum 11 and configured to uniformly charge a surface of photosensitive drum 11, developing unit 20 configured to develop an image by applying toner or a developer to an electrostatic latent image serving as a latent image formed on a surface of photosensitive drum 11 so as to form a toner image or a developer image, and cleaning blade 18 serving as a cleaning member configured to collect toner remaining on photosensitive drum 11 after an image transfer.

Developing unit 20 includes developing roller 14 serving as a developer carrier provided to contact with photosensitive drum 11, toner supply roller 15 serving as a developer supplier provided to contact with developing roller 14 and configured to charge toner and supply the charged toner to developing roller 14, and development blade 16 serving as a developer regulatory member provided so that its end contacts with developing roller 14 and configured to form a thin toner layer with a uniform thickness on developing roller 14. Toner is provided to developing unit 20 from a toner cartridge (not shown). Note that photosensitive drum 11, charging roller 12, developing roller 14, toner supply roller 15, development blade 16 and the like constitute the image forming elements of image forming unit 10.

LED head 13 serving as an exposure unit is arranged above image forming unit 10 facing photosensitive drum 11. LED head 13 exposes light onto the surface of photosensitive drum 11 to form the electrostatic latent image. Further, transfer roller 17 serving as a transferring member is arranged under image forming unit 10 so as to face and contact photosensitive drum 11. Transfer roller 17 is configured to transfer the toner image formed on photosensitive drum 11 to paper sheet P or any other printing media.

Photosensitive drum 11 is formed, for example, by coating a photoconductive layer on a surface of a cylindrical conductor made of aluminum and the like. Charging roller 12 is formed, for example, by covering a conductive shaft made of stainless steel and the like with a conductive elastic member such as an epichlorohydrin rubber and the like. Further, developing roller 14 is, for example, formed by covering a conductive shaft made of stainless steel and the like with a conductive elastic member such as urethane and the like. Toner supply roller 15 is formed, for example, by covering a conductive shaft made of stainless steel and the like with a foamed elastic member such as silicone and the like. Development blade 16 is formed, for example, of a plate member made of stainless steel.

Further, LED head 13 includes an LED element, an LED driving element and a lens array. LED head 13 is disposed such that the light emitted by the LED element is focused on an area on photosensitive drum 11 where an image is to be formed. Transfer roller 17 is formed, for example, of a conductive foam. Cleaning blade 18 is formed, for example, of a rubber blade and the like.

In order to feed paper sheet P between image forming unit 10 and transfer roller 17, paper cassette 21 serving as a media container for containing paper sheets P and hopping roller 22 serving as a feeding roller for separating paper sheets P are provided at the bottom of the printer. Downstream of hopping roller 22 in a medium transport path for transporting paper sheets P, resist roller 25 serving as a transporting member is disposed. Further, downstream of image forming unit 10 in the medium transport path, fixing unit 27 serving as a fixing device and a pair of discharging rollers 28 are provided. The pair of discharging rollers 28 discharges paper sheet P which has been passed thought fixing unit 27 out of the printer.

Fixing unit 27 presses and heats the toner image transferred on paper sheet P so that the image is fixed onto paper sheet P.

Photosensitive drum 11 is driven by activating a drum motor 32 (not shown in FIG. 2) to rotate in the direction indicated by arrow A. Charging roller 12, developing roller 14, toner supply roller 15 and transfer roller 17 rotate in the direction indicated by the arrow (that is, the opposite direction of arrow A), in response to the rotation of photosensitive drum 11.

Next, operations of the printer having the above configuration will be described.

In the printer, hopping roller 22 separates sheet P from paper cassette 21, and feeds sheet P so that sheet P is transported along the medium transport path. Resist roller 25 corrects the orientation of sheet P, and then, sheet P passes through between image forming unit 10 and transfer roller 17 while the toner image on photosensitive drum 11 is transferred to sheet P. Sheet P having the transferred toner image thereon is sent to fixing unit 27, and thereby fixing unit 27 presses and heats the toner image so that the image is fixed on sheet P. Discharging roller 28 then discharges sheet P.

The controller of the printer will now be described.

FIG. 1 is a control block diagram of the printer according to the first embodiment.

Development voltage controller 34 is connected to developing roller 14 to apply development voltage. Supply voltage controller 35 is connected to toner supply roller 15 to apply supply voltage. Development blade voltage controller 36 is connected to development blade 16 to apply development blade voltage. Charging voltage controller 37 is connected to charging roller 12 to apply charging voltage. In addition, supply voltage switch unit 38 is connected to supply voltage controller 35 and charging voltage switch unit 39 is connected to charging voltage controller 37.

Development voltage controller 34, development blade voltage controller 36, supply voltage switch unit 38 and charging voltage switch unit 39 are connected to controller 42. Controller 42 includes image formation voltage setting unit 40 serving as a first voltage setting unit, post unoperated period image formation preparation voltage setting unit 41 serving as a second voltage setting unit and post unoperated period image formation voltage setting unit 103 serving as a third voltage setting unit.

Controller 42 sends an instruction to supply voltage switch unit 38 and charging voltage switch unit 39 so as to select voltage values to be sent to supply voltage controller 35 and charging voltage controller 37 from an image formation voltage stored in image formation voltage setting unit 40, a post unoperated period image formation preparation voltage (adjusting sequence voltage) stored in post unoperated period image formation preparation voltage setting unit 41 and a post unoperated period image formation voltage stored in post unoperated period image formation voltage setting unit 103.

Supply voltage controller 35 and charging voltage controller 37 output voltage to toner supply roller 15 and charging roller 12 according to the voltage values sent from supply voltage switch unit 38 and charging voltage switch unit 39.

Further, motor controller 43 is connected to drum motor 32 serving as a drive unit; transfer voltage controller 44 is connected to transfer roller 17; LED head emission controller 45 is connected to LED head 13; and fixing unit temperature controller 100 is connected to fixing unit 27. Motor controller 43, transfer voltage controller 44, LED head emission controller 45 and fixing unit temperature controller 100 are connected with controller 42 so as to control drive of drum motor 32, a transfer voltage applied to transfer roller 17, an emission operation of LED head 13 and fixing unit temperature of fixing unit 27 according to instructions from controller 42.

Further, controller 42 reads a drum count value measured and output by drum count value measuring unit 46 serving as a total rotation number measuring unit and a period (or time)

measured and output by timer 47 and registers them in storage unit 48. Note that the drum count value represents a total rotation of photosensitive drum 11. For example, the drum count value increases by 3 when three A4-size paper sheets P are printed in a row.

Next, operations of image forming unit 10 will be described.

Driving drum motor 32 rotates photosensitive drum 11 in the direction indicated by arrow A so that the surface of photosensitive drum 11 is uniformly negatively charged by charging roller 12 to which charging voltage is applied. Then, based on the image data sent from controller 42, LED head 13 emits light onto the surface of photosensitive drum 11 to form an electrostatic latent image on the surface of photosensitive drum 11.

Then, toner on developing roller 14 is adhered to the electrostatic latent image on photosensitive drum 11 so that the electrostatic latent image is developed to form a toner image. Here, development voltage is applied on developing roller 14 having a thin toner layer thereon so that developing roller 14 develops the electrostatic latent image on photosensitive drum 11 to form the toner image.

Further, in order to uniformly form the thin toner layer on developing roller 14 and obtain the predetermined charge amount of the toner in the thin layer, supply voltage and development blade voltage are applied to toner supply roller 15 and development blade 16, respectively.

Next, transfer roller 17, which receives transfer voltage, transfers the toner image on photosensitive drum 11 onto paper sheet P and fixing unit 27 fixes the toner image on paper sheet P. Discharging roller 28 discharges paper sheet P. Note that cleaning blade 18 scrapes and removes untransferred toner remaining on photosensitive drum 11 off photosensitive drum 11.

In operation of the printer using negatively charged toner in an environment at room temperature and relative humidity, the applied voltages are set so that the charging voltage is −1000 V, the development voltage is −200 V, the supply voltage is −280 V, and the development blade voltage is −280 V, for example.

When charging voltage applied to charging roller 12 is equal to or greater than a specified value, the surface of photosensitive drum 11 is charged and its surface potential varies in proportional to the applied charging voltage. In this embodiment, the surface potential of photosensitive drum 11 is set as −500 V. Accordingly, the voltage of the electrostatic latent image formed by LED head 13, that is, the latent image voltage becomes −50 V. With this, toner on developing roller 14 is adhered to the electrostatic latent image so that a reversal development is performed. Note that negative polarity toner is, for example, formed of polystyrene resin with added silica and the like which produces polystyrene resin polarity and fluidity.

When the printer stands unoperated for a while, some toner may have less polarity than normal or may have opposite polarity (positive polarity, in this embodiment), due to a natural electric discharge. Such a lower polarity toner can be adhered to the surface of photosensitive drum 11 as fog toner. In such a case, fog toner may be adhered on non-image areas of paper sheet P so as to cause fogging.

A fog level, which is a level of fogging generated when the printer prints an image, will be described.

Figure 3:
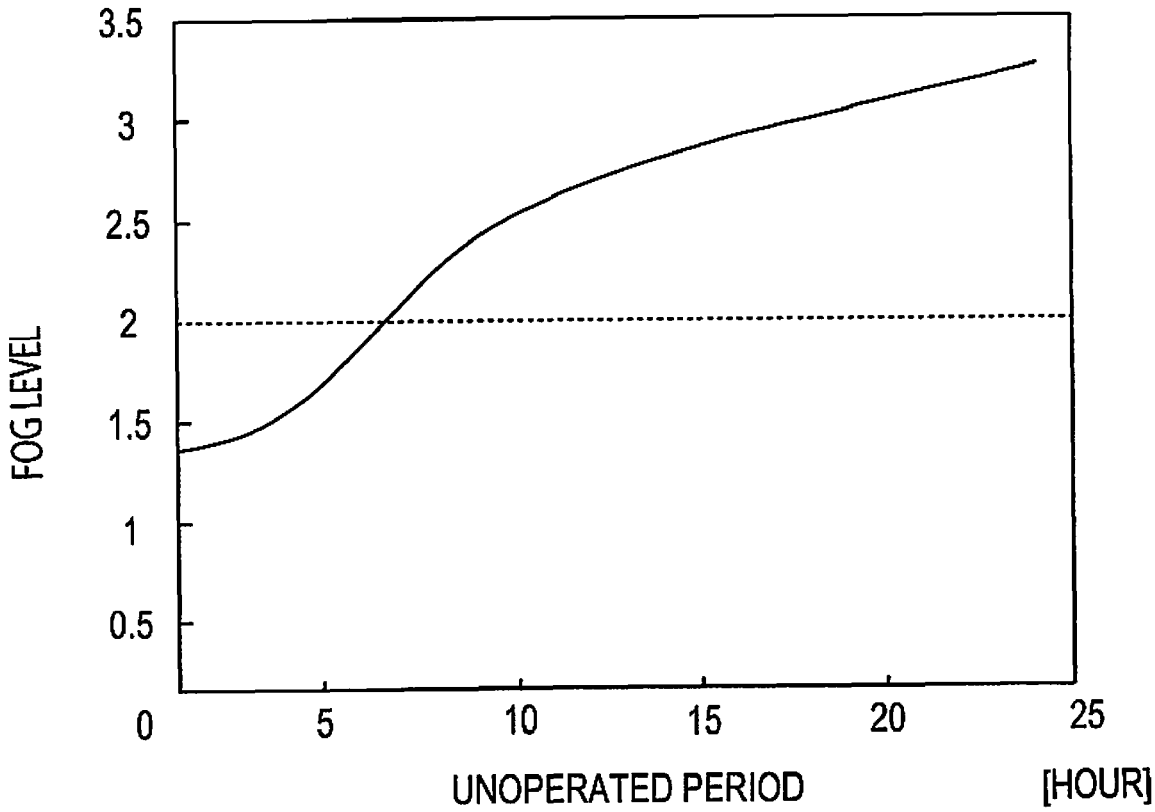
FIG. 3 is a diagram showing a transition of a fog level according to the first embodiment.

FIG. 3 is a diagram showing a transition of fog level according to the first embodiment. In this case, the higher fog level indicates more fogging generated.

As shown in FIG. 3, as the printer is left standby for longer periods, fog level increases. Further, when the unoperated period becomes longer than about three hours, fogging occurs increasingly. When the unoperated period becomes longer than six hours, the fog level reaches "2" above which the image quality is no longer acceptable.

Figure 4:
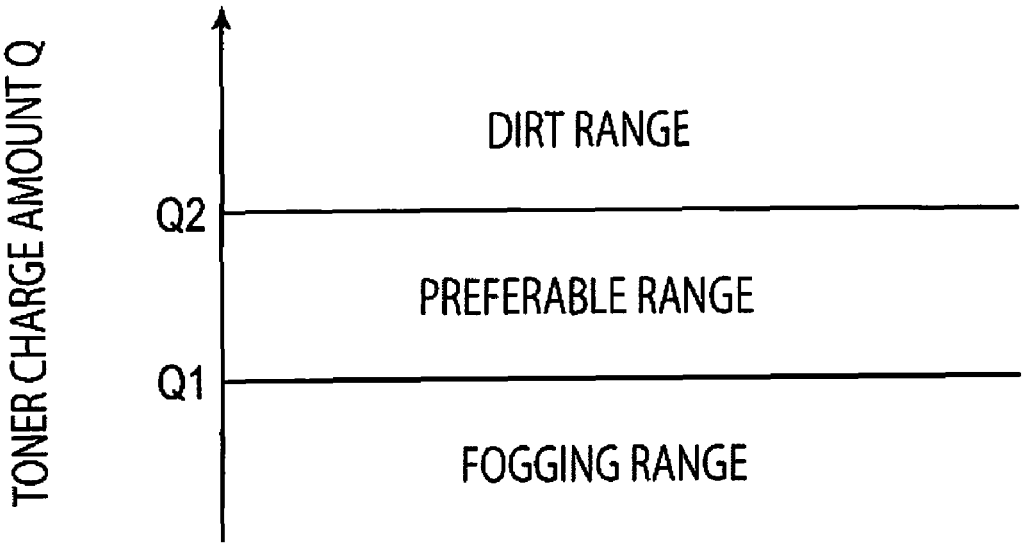
FIG. 4 is a diagram showing a fogging occurrence condition related to a toner charge amount according to the first embodiment.

FIG. 4 is a diagram showing a fogging condition related to toner charge amount according to the first embodiment. In this case, a printer performs a reversal development.

In FIG. 4, the vertical axis indicates the charge level of toner, that is, toner charge amount Q. Since the toner is negatively charged, the higher the toner charge amount Q on the vertical axis in FIG. 4, the larger the toner charge amount Q in the negative direction, and also, the lower the toner charge amount Q on the vertical axis in FIG. 4, the smaller the toner amount Q in the negative direction.

Level Q1 is a lower limit of the toner charge amount to prevent an occurrence of fogging on the surface of photosensitive drum 11. Level Q2 is an upper limit of the toner charge amount to prevent an occurrence of a dirt phenomenon in which toner charged more than normal electric potential level adheres on the surface of photosensitive drum 11.

In other words, when toner charge amount Q is greater than Q1, the range is a fogging range in which fogging occurs.

In contrast, when toner charge amount Q is less than Q2, the range is a dirt range in which dirt occurs.

Therefore, when toner charge amount Q is in the range $Q1 \leqq Q \leqq Q2$, this is a preferred range so that toner on developing roller 14 is not adhered on the surface of photosensitive drum 11 and the occurrence of fogging is prevented.

Figure 5:
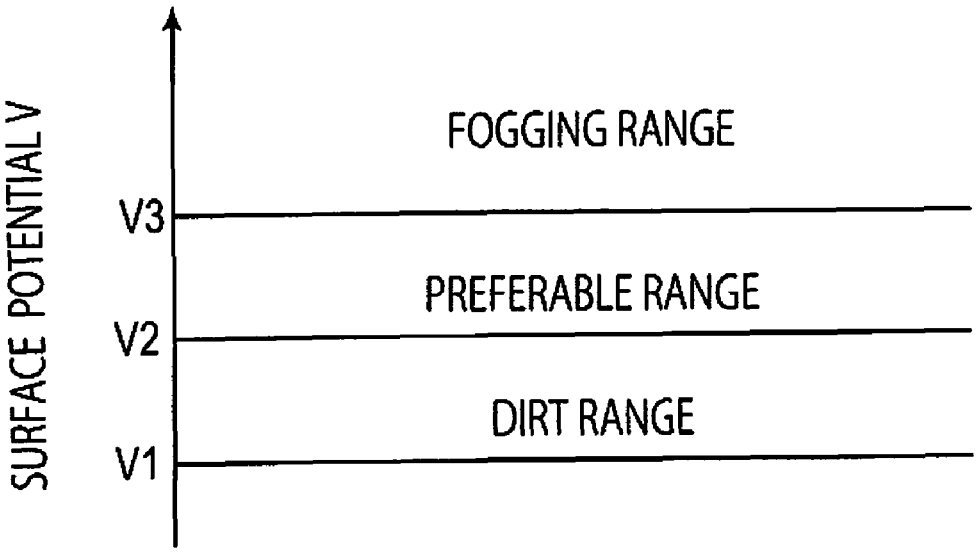
FIG. 5 is a diagram showing a fogging occurrence condition related to a surface potential on a photosensitive drum according to the first embodiment.

FIG. 5 is a diagram showing a fogging condition related to the surface potential on photosensitive drum 11 according to the first embodiment.

In FIG. 5, the vertical axis indicates the level of surface potential V' of photosensitive drum 11. Since the toner is negatively charged, the higher the surface potential V' on the vertical axis in FIG. 5, the larger the surface potential V' in the negative direction, and also, the lower the surface potential V' the vertical axis in FIG. 5, the smaller the surface potential V' in the negative direction.

In FIG. 5, level V1 is an electrical potential which is the electrical potential of the toner layer on developing roller 14 plus the development voltage applied to developing roller 14. Level V2 is a lower limit of electrical potential to prevent an occurrence of dirt on photosensitive drum 11. Level V3 is an upper limit of electrical potential to prevent an occurrence of fogging on the surface of photosensitive drum 11.

In other words, when surface potential V' satisfies the condition $V1 \leqq V' < V2$, the range is a dirt range in which dirt occurs.

When surface potential V' satisfies the condition $V3 < V'$, the range is a fogging range in which fogging occurs.

Therefore, when surface potential V' is in the range $V2 \leqq V' \leqq V3$, this is a preferable range so that toner on developing roller 14 is not adhered on the surface of photosensitive drum 11 and the occurrence of fogging is prevented.

The longer the unoperated period which is a period from an end of a print job to a start of another print job, the lower the toner charge amount Q. The lower the charge amount Q, the lower the surface potential V' which is the electrical potential of toner layer. Accordingly, upper limit potential V3 for preventing the occurrence of fogging becomes lower and this causes that surface potential V' to drop the fogging range. As a result, toner charge amount Q and surface potential V' are in the fogging range so that fogging occurs.

In order to make toner charge amount Q and surface potential V' in the preferable ranges even when the printer is left unoperated for a long period of time, this embodiment provides an adjustment sequence. In the adjustment sequence, the voltages applied to predetermined image forming elements, which are the charging voltage (which is the voltage applied to charging roller 12) and the supply voltage (which is the voltage applied to toner supply roller 15) in this embodiment, are adjusted according to the length of the unoperated period such that the charging voltage and supply voltage for a print preparation operation are different from those for a normal printing operation. In the adjustment sequence, an idling operation is performed to rotate photosensitive drum 11 (charging roller 12, developing roller 14, toner supply roller 15 and transfer roller 17 are idled accordingly) while applying the adjusted voltages for the print preparation. Note that, in the adjustment sequence, the duration of idling photosensitive drum 11, which is an idling time, is set according to the length of the unoperated period.

Figure 6:
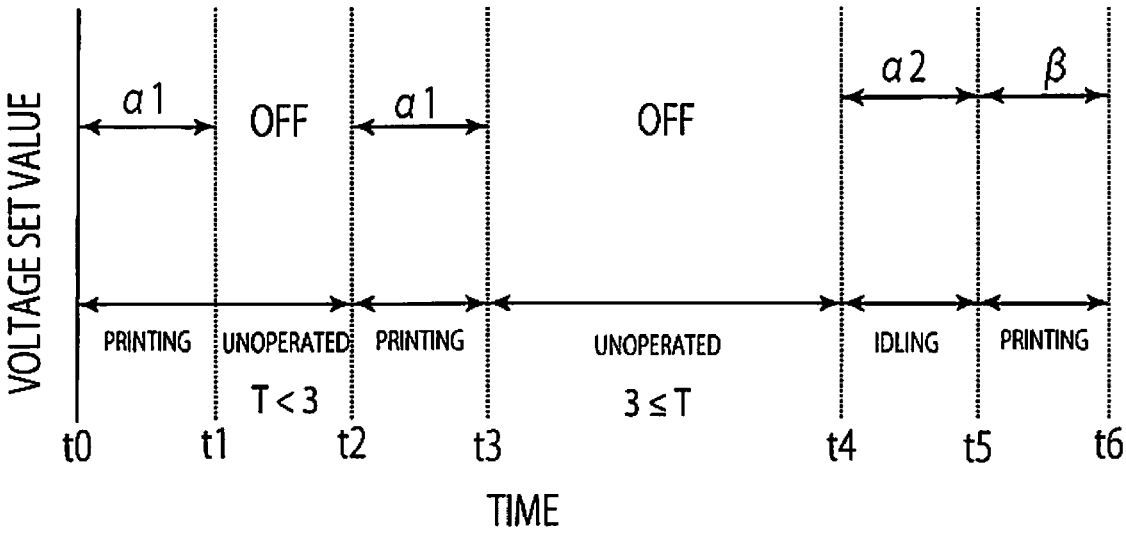
FIG. 6 is a time chart of an operation of the printer according to the first embodiment.

FIG. 6 is a time chart of an operation of the printer according to the first embodiment.

In FIG. 6, between time t0 and t1, image formation voltage setting unit 40 sets the voltage values to image formation voltages $\alpha 1$ which are standard voltages. Then, a standard image formation processor (not shown) of controller 42 performs a standard image formation process to activate image forming unit 10 and LED head 13 to form an image with applying image formation voltages $\alpha 1$ to charging roller 12 and toner supply roller 15.

Image formation voltage $\alpha 1$ for charging voltage is set as $\alpha 1=-1000$ V. Image formation voltage $\alpha 1$ for supply voltage is set as $\alpha 1=-280$ V.

After printing ends at time t1), the printer will be left unoperated. Timer 47 starts measuring at time t1 when printing ends and stops measuring at timing t2 when subsequent printing starts. In other words, timer 47 measures the time length from timing t1 to t2 so as to obtain the time length as unoperated period T. Then, an unoperated period judgment processor (not shown) of controller 42 executes an unoperated period judgment process. The unoperated period judgment processor reads unoperated period T and determines whether the printer is left unoperated for a long period of time. For example, it determines whether unoperated period T is equal to or greater than threshold $\tau 1$, which is three hours in this embodiment.

In other words, the unoperated period judgment processor determines that the printer has not been unoperated for a long period of time when unoperated period T is less than 3 hours and determines that the printer has been unoperated for a long period of time when unoperated period T is equal to or less than 3 hours.

When it is determined that the printer has not been unoperated for a long time, image formation voltage setting unit 40 sets the voltage set values to image formation voltages $\alpha 1$.

Then, when the printing ends at time t3 timer 47 starts to measure the unoperated period. When a print starts again at time t4, timer 47 stops to measure the unoperated period. In other words, timer 47 measures the time length from timing t3 to t4 so as to obtain unoperated period T. The unoperated period judgment processor reads unoperated period T and determines whether the printer has been unoperated for a long period of time, for example, whether unoperated period T is equal to or greater than 3 hours in this embodiment, as described above.

Then, when unoperated period T is equal to greater than 3 hours, the unoperated period judgment processor determines that the printer has been unoperated for a long period of time. Post unoperated period image formation preparation voltage setting unit 41 sets the voltage values to post unoperated period image formation preparation voltages $\alpha 2$ serving as a first voltage which is adjusted. A post unoperated period image formation preparation processor (not shown) of controller 42 executes a post unoperated period image formation preparation process to perform an idling operation to rotate photosensitive drum 11 between times t4 and t5 while applying post unoperated period image formation preparation voltages $\alpha 2$ to charging roller 12 and toner supply roller 15. In this idling operation, since LED head 13 is not activated to emit light, developing roller 14 does not execute development so as not to form any image.

Next, post unoperated period image formation voltage setting unit 103 sets the voltage value to post unoperated period image formation voltage $\beta$ serving as a second voltage which is adjusted. A post unoperated period image formation processor (not shown) of controller 42 executes a post unoperated period image formation process to operate image forming unit 10 and LED head 13 to form an image between times t5 and t6 while applying post unoperated period image formation voltages $\beta$ to charging roller 12 and toner supply roller 15.

Next, operations of controller 42 after the printer is left unoperated for a long time will be described.

Figure 7:
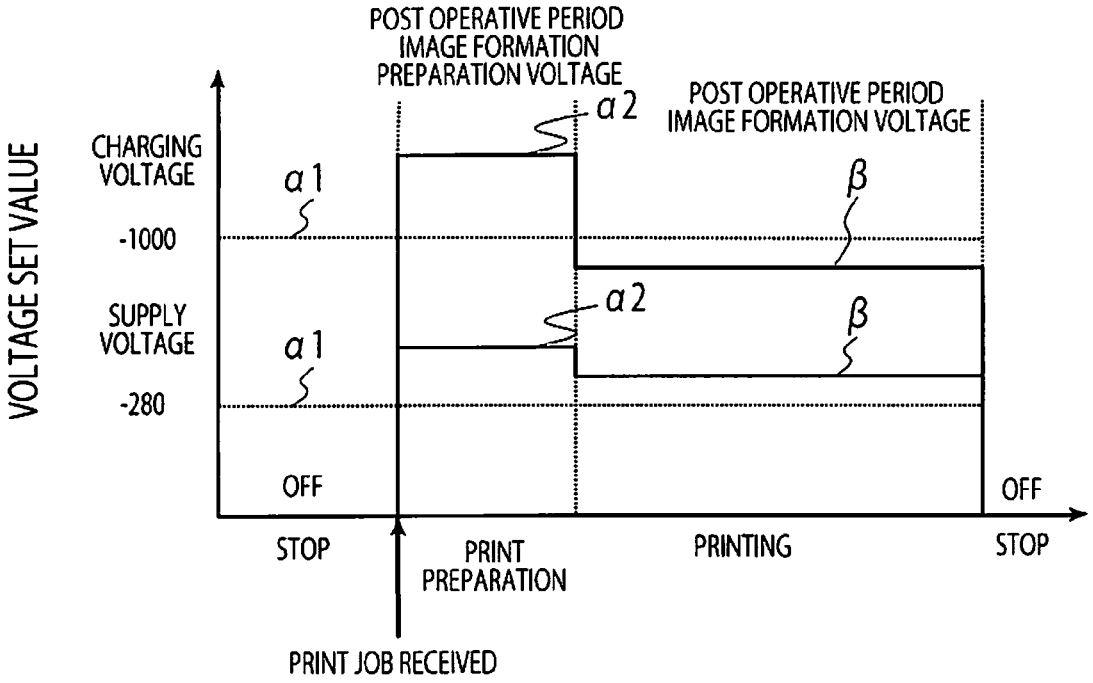
FIG. 7 is a time chart of an operation of a controller after an unoperated period when the printer is left unused, according to the first embodiment.

FIG. 7 is a time chart of an operation of a controller after an unoperated period according to the first embodiment.

As described above, when a print job is sent from the host apparatus (the external apparatus), the unoperated period judgment processor reads unoperated period T and determines whether the printer has been unoperated for a long time, that is, whether unoperated period T is equal to or greater than 3 hours. When unoperated period T is equal to or greater than 3 hours, post unoperated period image formation preparation voltage setting unit 41 sets the voltage values to post unoperated period image formation preparation voltages $\alpha 2$ which are greater in the negative direction (which have greater absolute values) than image formation voltages $\alpha 1$.

In this case, post unoperated period image formation preparation voltages $\alpha 2$ are set by adding charging voltage adjustment value CH to image formation voltage $\alpha 1$ for the charging voltage and adding supply voltage adjustment value SB to image formation voltage $\alpha 1$ for the supply voltage.

As shown in Table 1, charging voltage adjustment value CH and/or supply voltage adjustment value SB is set to be changed according to whether unoperated period T is shorter than threshold value $\tau 2$, which is 6 hours in this embodiment.

TABLE 1

| | UNOPERATED PERIOD (HOURS) | |
|---|---|---|
| | $3 \leqq T < 6$ | $6 \leqq T$ |
| CHARGING VOLTAGE ADJUSTMENT VALUE (V) | −100 | −100 |
| SUPPLY VOLTAGE ADJUSTMENT VALUE (V) | −20 | −50 |

In other words, when unoperated period T satisfies the condition 3 (hours)$\leqq$T<6 (hours), charging voltage adjustment value CH is set to −100 V and supply voltage adjustment value SB is set to −20 V, and when unoperated period T is equal to or less than 6 hours, charging voltage adjustment value CH is set to −100 V and supply voltage adjustment value SB is se to −50 V. As described above, charging voltage adjustment value CH is not changed regardless of the length of unoperated period T but supply voltage adjustment value SB becomes greater in a negative direction (greater absolute value) as unoperated period T becomes longer.

A rotation number detection unit (not shown) of controller 42 reads the drum count value. According to the drum count value, the post unoperated period image formation preparation processor applies post unoperated period image formation preparation voltages α2 to charging roller 12 and toner supply roller 15.

A rotation number detection processor (not shown) of controller 42 executes a rotation number detection process to detect a drum count value that is a rotation number N of photosensitive drum 11 after the beginning of a post unoperated period image formation preparation process. The post unoperated period image formation preparation processor idles photosensitive drum 11 during a predetermined idling time which finishes when rotation number N reaches rotation number Na which is a first threshold. In this case, as shown in Table 2, rotation number Na is set in correspondence with unoperated period T. When unoperated period T satisfies the condition, 3 (hours)≦T<6 (hours), rotation number Na is set to 3. When unoperated period T satisfies the condition, 6 (hours)≦T<9 (hours), rotation number Na is set to 5. When unoperated period T satisfies the condition, 9 (hours)≦T, rotation number Na is set to 10. In other words, as unoperated period T becomes longer, rotation number Na is set to be larger so that the idling time becomes longer.

TABLE 2

| | UNOPERATED PERIOD (HOUR) | | |
|---|---|---|---|
| | 3 ≦ T < 6 | 6 ≦ T < 9 | 9 ≦ T |
| ROTATION NUMBER Na | 3 | 5 | 10 |

Then, when the drum count reaches rotation number Na, post unoperated period image formation voltage setting unit 103 sets the voltage values to post unoperated period image formation voltages β. For the charging voltage, post unoperated period image formation voltage β is set smaller than image formation voltage α1 and post unoperated period image formation preparation voltage α2 in the negative direction (a smaller absolute value). For the supply voltage, post unoperated period image formation voltage β is set greater than image formation voltage α1 in the negative direction (a greater absolute value) and smaller than post unoperated period image formation preparation voltage α2 in the negative direction (a smaller absolute value).

Post unoperated period image formation voltages β are set by adding charging voltage adjustment value CH to image formation voltage α1 for the charging voltage and supply voltage adjustment value SB to image formation voltage α1 for the supply voltage.

As shown in Table 3, supply voltage adjustment value SB is set to be different values according to whether unoperated period T is shorter than 6 hours.

TABLE 3

| | UNOPERATED PERIOD (HOURS) | |
|---|---|---|
| | 3 ≦ T < 6 | 6 ≦ T |
| CHARGING VOLTAGE ADJUSTMENT VALUE (V) | +50 | +50 |
| SUPPLY VOLTAGE ADJUSTMENT VALUE (V) | 0 | −20 |

In other words, when unoperated period T satisfies the condition, 3 (hours)≦T<6 (hours), charging voltage adjustment value CH is set as +50 V and supply voltage adjustment value SB is set as 0 V. When unoperated period T satisfies the condition, 6≦T (hours), charging voltage adjustment value CH is set as +50 V and supply voltage adjustment value SB is set as −20 V. In this manner, charging voltage adjustment value CH is constant regardless of the length of unoperated period T but the supply voltage adjustment value SB is set greater in the negative direction as unoperated period T becomes longer.

The post unoperated period image formation processor operates image forming unit 10 and LED head 13 to form an image while applying post unoperated period image formation voltages β to charging roller 12 and toner supply roller 15.

Next, the following describes a condition for returning an image formation with post unoperated period image formation voltage β to an image formation with image formation voltage α1.

Figure 8:
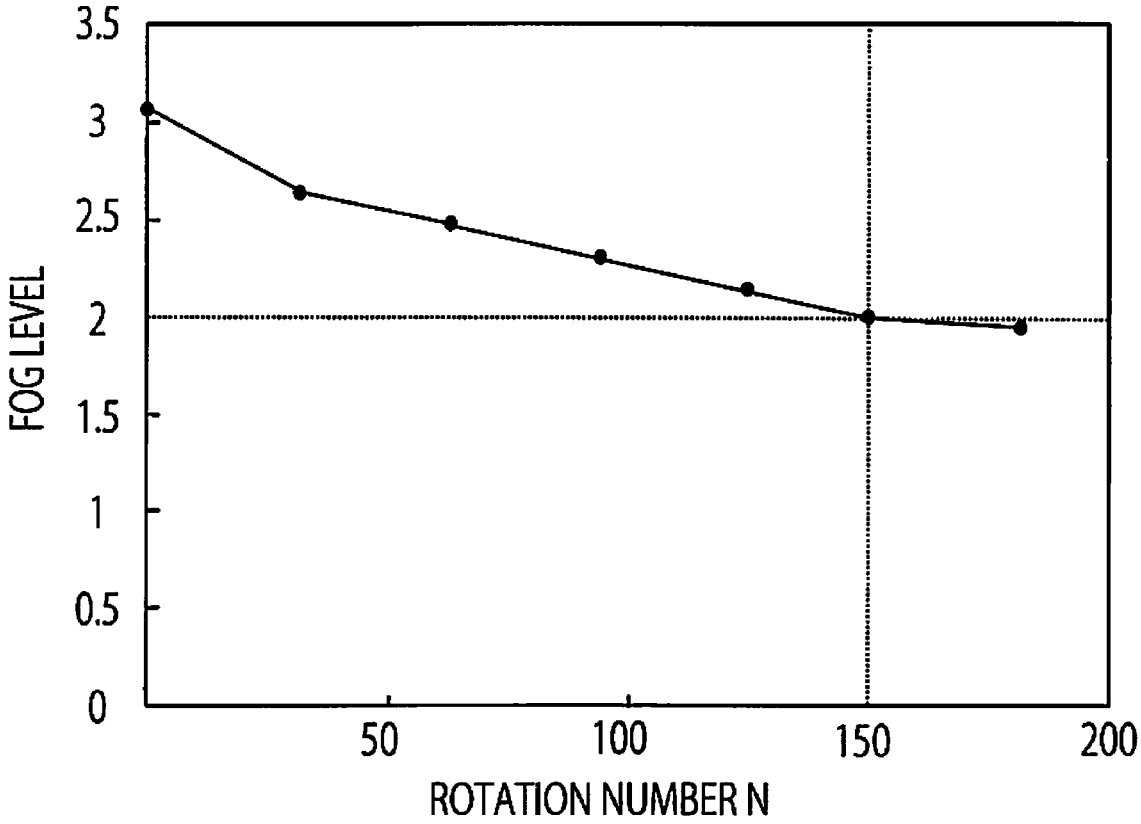
FIG. 8 is a diagram showing a transition of a fog level during printing after an unoperated period according to the first embodiment.

FIG. 8 is a diagram showing a transition of fog level of printing after an unoperated period according to the first embodiment. In FIG. 8, the horizontal axis indicates rotation number N of photosensitive drum 11 and the vertical axis indicates fog level.

As shown in FIG. 8, when a printing is executed after the printer is left unoperated for a long period of time, the larger the rotation number N of photosensitive drum 11, the smaller the fog level. When the rotation number reaches a predetermined value, which is 150 for example, the fog level becomes "2" which assures an acceptable image quality.

In this embodiment, after printing is started using post unoperated period image formation preparation voltage α2, the post unoperated period image formation preparation process is executed until detected rotation number N (the drum count) reaches predetermined rotation number Nb serving as a second threshold (which is 150 in this embodiment). When the drum count reaches 150, a standard image formation processor performs a normal printing while applying image formation voltages α1 to charging roller 12 and toner supply roller 15.

Note that, in this embodiment, an power source (not shown) of the printer is kept turned on while the printer is left unoperated. However, the power source of the printer may include a main power source such as a commercial power source and the like and an auxiliary power source such as a battery and the like so that even while the main power source is being turned off, the auxiliary power source supplies power to timer 47 to activate timer 47.

As described above, according to the embodiment, when unoperated period T of the printer becomes greater than 3 hours, a post unoperated period image formation preparation process is executed so that toner charge amount Q and surface potential V' are maintained in a preferable range. This improves the image quality. Further, according to the embodiment, since a post unoperated period image formation process is executed after the post unoperated period image formation preparation process, toner charge amount Q and surface potential V' are maintained in a more preferable range. This further improves the image quality.

Next, a second embodiment will be described. Note that components having the same configurations as those of the first embodiment are denoted by the same reference numbers and the effects achieved by the same configuration are omitted.

Figure 9:
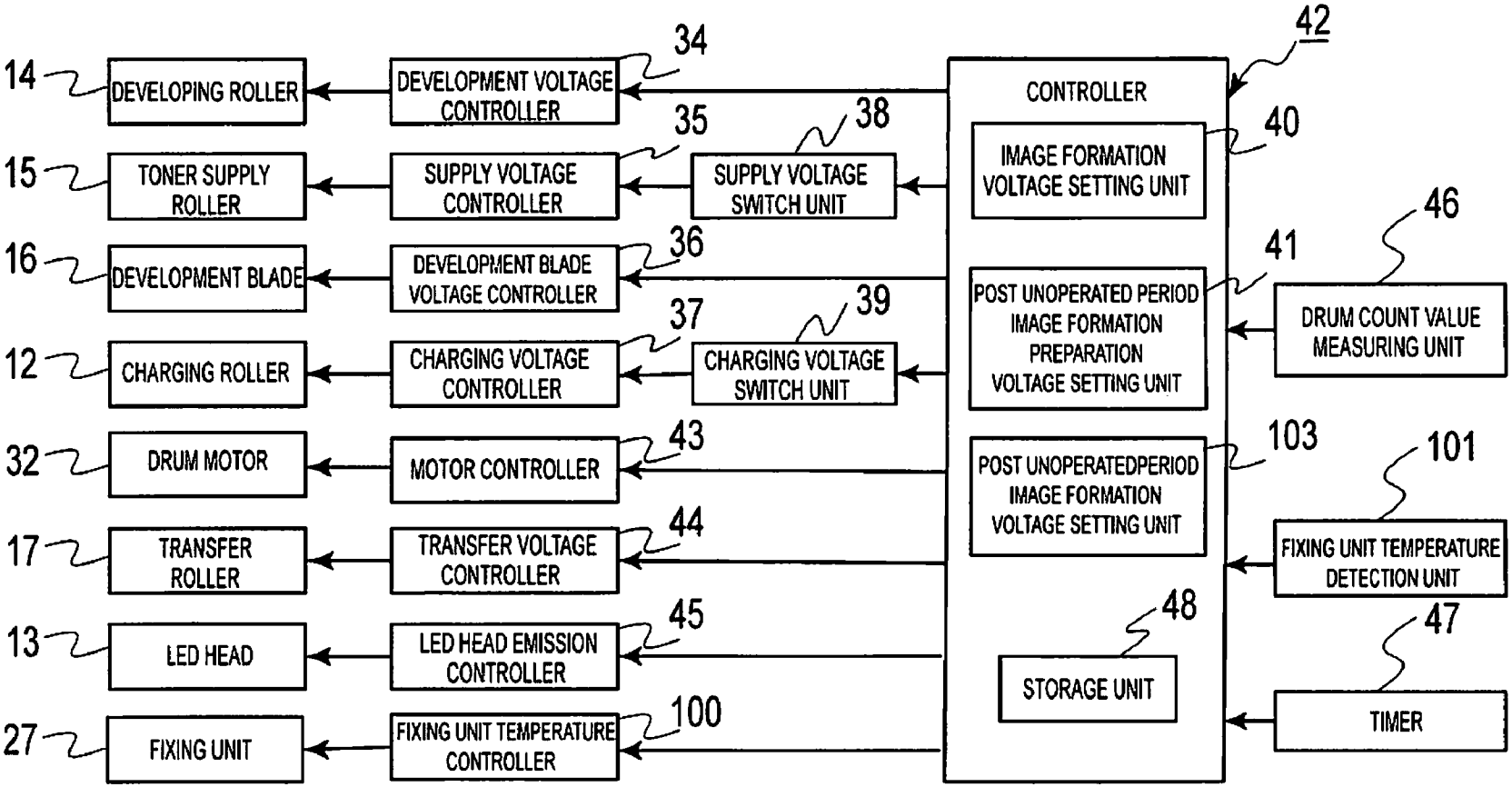
FIG. 9 is a control block diagram of a printer according to a second embodiment.

FIG. 9 is a control block diagram of a printer of the second embodiment.

In this embodiment, a printer has fixing unit temperature detection unit 101 which is disposed at a predetermined position in fixing unit 27. Fixing unit temperature detection unit 101 detects temperature of fixing unit 27, which is referred to as fixing unit temperature, and sends it to controller 42. Controller 42 reads the fixing unit temperature and records it to storage unit 48.

In this embodiment, the printer does not have an auxiliary power source such as a battery and the like and it is assumed that the printer is turned off after the printer is left unoperated.

Figure 10:
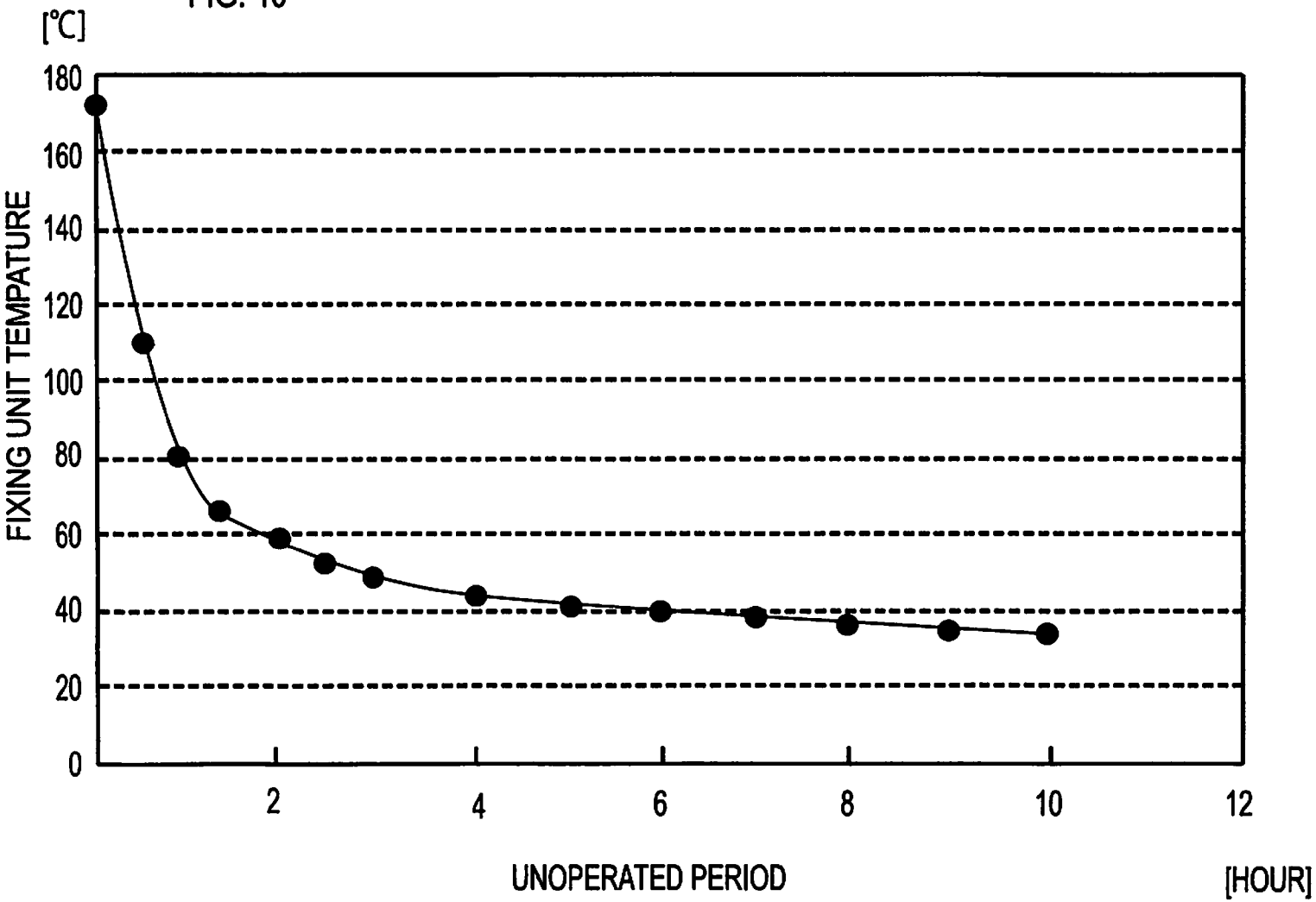
FIG. 10 is a diagram showing a transition of fixing unit temperature according to the second embodiment.

FIG. 10 is a diagram showing a transition of the fixing unit temperature according to the second embodiment. In FIG. 10, the horizontal axis indicates the unoperated period and the vertical axis indicates the fixing unit temperature.

In the embodiment, the fixing unit temperature is set to 170° C. during a printing; however, this setting can be changed as needed according to the type and thickness of paper sheet P serving as a medium and peripheral temperature of the printer.

As shown in FIG. 10, the longer the unoperated period, the lower the fixing unit temperature.

According to the embodiment, a unoperated period estimation processor (not shown) of controller 42 executes an unoperated period estimation process. The unoperated period estimation processor reads the fixing unit temperature serving as end temperature Fe when the printing ends and reads the fixing unit temperature serving as start temperature Fs when printing starts again after the printer is kept unoperated. The unoperated period estimation processor estimates an unoperated period based on fixing unit temperature difference F which is a difference between end temperature Fe and start temperature Fs.

For this process, a fixing unit temperature difference calculation processor (not shown) of controller 42 performs a fixing unit temperature difference calculation process to read end temperature Fe and start temperature Fs and calculate fixing unit temperature difference F.

Subsequently, the unoperated period judgment processor reads fixing unit temperature difference F and determines whether the printer has been unoperated for a long time, that is, determines whether fixing unit temperature difference F is equal to or greater than threshold f1, which is 120° C. in this embodiment (determines whether estimated unoperated period T is equal to or greater than 3 hours).

When fixing unit temperature difference F is equal to or greater than 120° C., the unoperated period judgment processor determines that the printer has been unoperated for a long time and post unoperated period image formation preparation voltage setting unit 41 serving as a second voltage setting unit sets the voltage value to post unoperated period image formation preparation voltage $\alpha$2 serving as the first voltage which is adjusted. The post unoperated period image formation preparation processor performs the idling operation to rotate photosensitive drum 11 for a predetermined idling time while applying post unoperated period image formation preparation voltages $\alpha$2 to charging roller 12 and toner supply roller 15.

In this embodiment, post unoperated period image formation preparation voltage $\alpha$2 is set by adding charging voltage adjustment value CH to image formation voltage $\alpha$1 for charging voltage and by adding supply voltage adjustment value SB to image formation voltage $\alpha$1 for the supply voltage.

As shown in Table 4, supply voltage adjustment value SB is changed according to whether fixing unit temperature difference F is equal to or greater than threshold f2, which is 130° C. in this embodiment (that is, determines whether estimated unoperated period T is equal to or greater than 6 hours).

TABLE 4

| | FIXING UNIT TEMPERATURE DIFFERENCE (° C.) | |
|---|---|---|
| | 120 ≦ F < 130 | 130 ≦ F |
| CHARGING VOLTAGE ADJUSTMENT VALUE (V) | −100 | −100 |
| SUPPLY VOLTAGE ADJUSTMENT VALUE (V) | −20 | −50 |

Subsequently, the post unoperated period image formation preparation processor operates the idling operation to rotate photosensitive drum 11 serving as an image carrier for the predetermined idling time while applying post unoperated period image formation preparation voltages $\alpha$2 to charging roller 12 serving as the charging unit or the charged member and toner supply roller 15 serving as the developer supplying member, until the drum count value reaches rotation number Na which is the first threshold. In this case, as shown in Table 5, rotation number Na is set corresponding to fixing unit temperature difference F.

TABLE 5

| | FIXING UNIT TEMPERATURE DIFFERENCE (° C.) | | |
|---|---|---|---|
| | 120 ≦ F < 130 | 130 ≦ F ≦ 135 | 135 ≦ F |
| ROTATION NUMBER Na | 3 | 5 | 10 |

When the drum count value reaches rotation number Na, post unoperated period image formation voltage setting unit 103 serving as the third voltage setting unit sets the voltage set value to post unoperated period image formation voltage $\beta$ serving as the second voltage which is adjusted. The post unoperated period image formation processor activates image forming unit 12 and LED head 13 to form an image while applying post unoperated period image formation voltages $\beta$ to charging roller 12 and toner supply roller 15.

Note that, post unoperated period image formation voltages $\beta$ are set by adding charging voltage adjustment value CH to image formation voltage $\alpha$1 for the charging voltage and by adding supply voltage adjustment value SB to image formation voltage $\alpha$1 for the supply voltage.

Then, as shown in Table 6, supply voltage adjustment value SB is changed according to whether fixing unit temperature F is less than 130° C.

TABLE 6

| | FIXING UNIT TEMPERATURE DIFFERENCE (° C.) | |
|---|---|---|
| | 120 ≦ F < 130 | 130 ≦ F |
| CHARGING VOLTAGE ADJUSTMENT VALUE (V) | +50 | +50 |
| SUPPLY VOLTAGE ADJUSTMENT VALUE (V) | 0 | −20 |

In this embodiment, since the printer has no auxiliary power source, timer 47 is unable to measure the length of the unoperated period when an operator turns off the printer. However, this embodiment estimates the unoperated period based on fixing unit temperature difference F so as to prevent fogging after an unoperated period.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image forming apparatus comprising:

an image forming unit including image forming unit elements, wherein the image forming elements include, an image carrier having a surface on which a latent image can be formed, a charging unit configured to receive a charging voltage and to charge the surface of the image carrier, a developer carrier configured to receive a development voltage and to form a developer image by adhering a developer on the latent image formed on the image carrier, and a developer supplier configured to receive a supply voltage and to supply the developer to the developer carrier, a fixing unit configured to fix the transferred developer image formed on a medium which has been transferred from the image carrier to the medium;

a voltage setting unit operable, when an unoperated time period, which is a time period from an end of an image forming operation to a start of a subsequent image forming operation, is equal to or greater than a threshold, to set a post unoperated period image formation preparation voltage which is different from a normal image formation voltage, according to the unoperated time period; and a post unoperated period image formation preparation processor operable to perform an idling operation to rotate the image carrier for a predetermined idling time while applying the post unoperated period image formation preparation voltage to a given one or more of the image forming elements, wherein the post unoperated period image formation preparation processor is configured to set different idling time periods based on different unoperated periods.

2. The image forming apparatus of claim 1, wherein the post unoperated period image formation preparation processor sets the predetermined idling time period longer as the unoperated period becomes longer.

3. The image forming apparatus of claim 2, wherein the post unoperated period image formation preparation processor sets the predetermined idling time period longer by setting an increased rotation number of the image carrier.

4. The image forming apparatus of claim 1, further comprising a timer measuring the unoperated time period.

5. The image forming apparatus of claim 1, further comprising a post unoperated period image formation processor operable to operate, after the idling operation ends, image formation process while applying a post unoperated period image formation voltage, which is different from a normal image formation voltage and the post unoperated period image formation preparation voltage, to the given one or more of the image forming elements.

6. The image forming apparatus of claim 1, wherein the given one or more image forming elements is the charging unit; and the voltage setting unit sets the post unoperated period image formation preparation voltage for the charging voltage.

7. The image forming apparatus of claim 1, wherein the given one or more image forming elements is the developer supplier; and the voltage setting unit sets the post unoperated period image formation preparation voltage for the supply voltage.

8. The image forming apparatus of claim 1, wherein the voltage setting unit sets the absolute value of the post idle period image formation preparation voltage greater than the absolute value of a normal voltage set value.

9. The image forming apparatus of claim 8, wherein the voltage setting unit sets the post unoperated period image formation preparation voltage for the supply voltage larger in absolute value as the unoperated period becomes longer.

10. The image forming apparatus of claim 1, wherein the voltage setting unit is configured to set different image formation preparation voltages based on different unoperated periods.

11. An image forming apparatus comprising:

an image forming unit including image forming unit elements, wherein the image forming elements include, an image carrier having a surface on which a latent image can be formed a charging unit configured to receive a charging voltage and to charge the surface of the image carrier, a developer carrier configured to receive a development voltage and to form a developer image by adhering a developer on the latent image formed on the image carrier, and a developer supplier configured to receive a supply voltage and to supply the developer to the developer carrier, a fixing unit configured to fix the transferred developer image formed on a medium which has been transferred from the image carrier to the medium;

a voltage setting unit operable, when an unoperated time period, which is a time period from an end of an image forming operation to a start of a subsequent image forming operation, is equal to or greater than a threshold, to set a post unoperated period image formation preparation voltage which is different from a normal image formation voltage, according to the unoperated time period;

a post unoperated period image formation preparation processor operable to perform an idling operation to rotate the image carrier for a predetermined idling time while applying the post unoperated period image formation preparation voltage to a given one or more of the image forming elements;

a fixing unit temperature detection unit operable to detect a temperature of the fixing unit; and an unoperated period estimation processor operable to estimate the unoperated time period based on the temperature of the fixing unit.

12. An image forming apparatus comprising:

an exposure unit operable to emit light:

an image forming unit including image forming unit elements, wherein the image forming elements include, an image carrier having a surface on which a latent image can be formed by the exposure unit, a charging unit configured to receive a charging voltage and to charge the surface of the image carrier, a developer carrier configured to receive a development voltage and to form a developer image by adhering a developer on the latent image formed on the image carrier, and a developer supplier configured to receive a supply voltage and to supply the developer to the developer carrier, a transfer unit configured to transfer the developer image from the image carrier to a medium, a fixing unit configured to fix the transferred developer image onto the medium;

a voltage setting unit operable, when an unoperated time period, which is a time period from an end of an image forming operation to a start of a subsequent image forming operation, is equal to or greater than a threshold, to set a post unoperated period image formation preparation voltage which is different from a normal image formation voltage, according to the unoperated time period, wherein the voltage setting unit is configured to set different image formation preparation voltages based on different unoperated periods; and a post unoperated period image formation preparation processor operable to perform an idling operation to operate the image forming unit for a predetermined idling time while applying the post unoperated period image formation preparation voltage to a given one or more of the image forming elements, without forming the latent image on the surface of the image carrier by the exposure unit.

13. The image forming apparatus of claim 12, wherein the post unoperated period image formation preparation processor sets the predetermined idling time period longer as the unoperated time period becomes longer.

14. The image forming apparatus of claim 13, wherein the post unoperated period image formation preparation processor sets the predetermined idling time period longer by setting an increased rotation number of the image carrier.

15. The image forming apparatus of claim 12, further comprising a timer measuring the unoperated time period.

16. The image forming apparatus of claim 12, further comprising a fixing unit temperature detection unit operable to detect a temperature of the fixing unit; and an unoperated period estimation processor operable to estimate the unoperated time period based on the temperature of the fixing unit.

17. The image forming apparatus of claim 12, further comprising a post unoperated period image formation processor operable to operate, after the idling operation ends, image formation process while applying a post unoperated period image formation voltage, which is different from a normal image formation voltage and the post unoperated period image formation preparation voltage, to the given one or more of the image forming elements.

18. The image forming apparatus of claim 12, wherein the given one or more image forming elements is the charging unit; and the voltage setting unit sets the post unoperated period image formation preparation voltage for the charging voltage.

19. The image forming apparatus of claim 12, wherein the given one or more image forming elements is the developer supplier; and the voltage setting unit sets the post unoperated period image formation preparation voltage for the supply voltage.

20. The image forming apparatus of claim 12, wherein the voltage setting unit sets the absolute value of the post idle period image formation preparation voltage greater than the absolute value of a normal voltage set value.

21. The image forming apparatus of claim 20, wherein the voltage setting unit sets the post unoperated period image formation preparation voltage for the supply voltage larger in absolute value as the unoperated period becomes longer.

22. The image forming apparatus of claim 12, wherein the post unoperated period image formation preparation processor is configured to set different idling time periods based on different unoperated periods.

* * * * *